US006804890B1

(12) United States Patent
Kennedy, Sr.

(10) Patent No.: US 6,804,890 B1
(45) Date of Patent: Oct. 19, 2004

(54) SCRIBE AND A METHOD OF USING SAME TO MARK A CURVED SURFACE

(76) Inventor: Patrick H. Kennedy, Sr., 1001 Lawndale Dr., Apt. #6, Fortuna, CA (US) 95540

( * ) Notice: Subject to any disclaimer, the term of this patent is extended or adjusted under 35 U.S.C. 154(b) by 0 days.

(21) Appl. No.: 10/621,212

(22) Filed: Jul. 17, 2003

(51) Int. Cl.[7] ..... B43L 13/00
(52) U.S. Cl. ..... 33/21.3; 33/42
(58) Field of Search ..... 33/21.1, 21.3, 33/27.01, 41.1, 41.5, 41.6, 42, 412, 529, 484, 485, 666, 677

(56) References Cited

U.S. PATENT DOCUMENTS 1,792,393 A * 2/1931 Phillips ..... 33/42
1,825,266 A * 9/1931 Fischer ..... 33/27.03
2,436,542 A * 2/1948 Black ..... 33/21.3
2,660,791 A * 12/1953 Howell et al. ..... 33/41.6
4,334,360 A * 6/1982 Burns et al. ..... 33/42
4,345,379 A 8/1982 Pettingill, Jr.
4,388,761 A * 6/1983 Henderson ..... 33/42
4,393,594 A 7/1983 Hoffman et al.
4,553,305 A 11/1985 Dearman
5,651,184 A 7/1997 Tutty
5,862,601 A * 1/1999 O'Brien et al. ..... 33/42

* cited by examiner

*Primary Examiner*—Christopher W. Fulton
(74) *Attorney, Agent, or Firm*—Donald R. Schoonover

(57) ABSTRACT

A scribe and a method of using the scribe to mark a cutting guide on one conduit, while also using a second conduit as a guide, is disclosed. The scribe includes a pivot which rests on the outer surface on one conduit. The scribe also includes a scribe element which engages the outer surface of the one conduit. The scribe is moved along the outer surfaces of the two conduits and makes a mark on the one conduit that precisely follows the shape and size of the second conduit. The one conduit is cut along the mark and the second conduit will precisely and accurately fit to the one conduit. A method of coupling two conduits using this scribe is also disclose.

4 Claims, 2 Drawing Sheets

FIG. 3A.
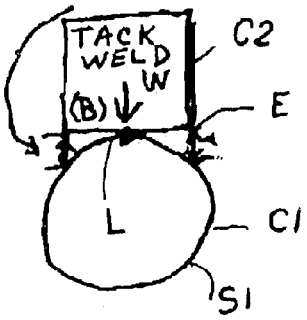
FIG. 3B.
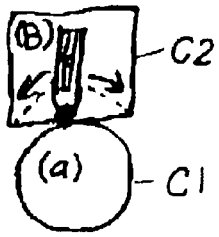
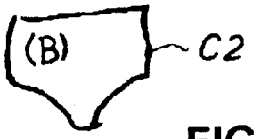
FIG. 3D.
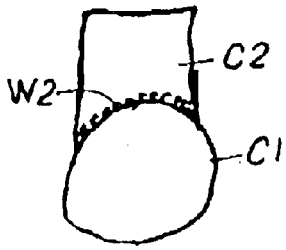
FIG. 3C.
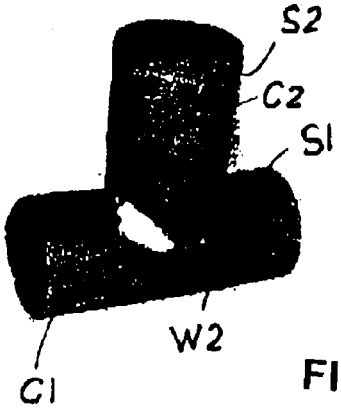
FIG. 4.

SCRIBE AND A METHOD OF USING SAME TO MARK A CURVED SURFACE

BACKGROUND OF THE INVENTION

1. Field of the Invention

The present invention relates to the general art of geometric instruments, and to the particular field of scribers used on curved surfaces.

2. Discussion of the Related Art

Pipe welders are often called upon to cut one conduit to engage a second conduit. The term "conduit" will be used to cover pipes, tubes and other such curved elements. At the present time, this procedure is carried out using a template. The template is formed by a template maker after the pipe welder has supplied dimensions. The template is then placed on a conduit to be cut and the conduit is cut.

This process requires the pipe fitter to wait until the template is supplied before proceeding with his work. This wait is wasteful of the pipe fitter's time and can be costly to his employer due to the down time of the pipe fitter. The wait can be anywhere from a few minutes to hours, or even days, depending on the circumstances.

Therefore, there is a need for a means and a method for defining a cutting guide mark on a conduit which will be joined to another conduit adjacent to the cut made along the cutting guide mark without requiring use of a template.

Often, the pipe fitter is in a location that is not convenient for obtaining a template. Not only does this increase the time required to obtain a template, it also increases the difficulty in obtaining the template.

Therefore, there is a need for a means and a method for in situ defining a cutting guide mark on a conduit which will be joined to another conduit adjacent to the cut made along the cutting guide mark without requiring use of a template.

Often, templates formed for one conduit may not be as accurate and as precise as possible for another conduit. This may be caused by manufacturing tolerances or environmental conditions or the like.

Therefore, there is a need for a means and a method for defining a cutting guide mark on a conduit which will be joined to another conduit-adjacent to the cut made along the cutting guide mark without requiring use of a template yet which can accurately and precisely mark each conduit.

PRINCIPAL OBJECTS OF THE INVENTION

It is a main object of the present invention to provide a means for defining a cutting guide mark on a conduit which will be joined to another conduit adjacent to a cut made along the cutting guide mark without requiring use of a template.

It is another object of the present invention to provide an in situ means for defining a cutting guide mark on a conduit which will be joined to another conduit adjacent to a cut made along the cutting guide mark without requiring use of a template.

It is a specific object of the present invention to provide a scribe for defining a cutting guide mark on a conduit which will be joined to another conduit adjacent to a cut made along the cutting guide mark without requiring use of a template.

It is another object of the present invention to provide a means for defining a cutting guide mark on a conduit which will be joined to another conduit adjacent to a cut made along the cutting guide mark without requiring use of a template and which will accurately and precisely define the cutting guide mark.

It is another object of the present invention to provide a method for defining a cutting guide mark on a conduit which will be joined to another conduit adjacent to a cut made along the cutting guide mark without requiring use of a template.

SUMMARY OF THE INVENTION

These, and other, objects are achieved by a conduit marking scribe comprising a body; a pivot unit on one end of the body, the pivot unit including a wheel which is adapted to contact the outer surface of a first conduit which will be engaged with a second conduit after the second conduit has been cut; and a scribe unit movably mounted on the body, the scribe unit including a scribe element which includes a distal end and which is movable between a first position having the distal end located inside the scribe unit and a second position having the distal end located outside the scribe unit with the distal end in position to contact the outer surface of the second conduit, and a biasing element which biases the scribe element toward the second position.

The objects are also achieved by a method of marking a conduit which includes providing the scribe unit described above, temporarily attaching one end of the second conduit to the outer surface of the first conduit at a location where the second conduit will be joined to the first conduit; contacting the wheel against the outer surface of the first conduit; contacting the wheel against the outer surface of the first conduit, contacting the wheel against the outer surface of the first conduit; locating the scribe unit against the outer surface of the second conduit; contacting the distal end of the scribe unit against the outer surface of the first conduit; and marking the second conduit by moving the scribe unit with respect to the first conduit and with respect to the second conduit so the distal end of the scribe unit engages and marks the second conduit while the wheel of the pivot unit remains in contact with the outer surface of the first conduit and moves over the outer surface of the first conduit.

The scribe will be used in place and thus the user need not wait for a template and will be able to define cutting guide marks that are accurate and precise for the particular job. In this way, if one particular job is slightly different from another, the scribe and method embodying the present invention can accommodate such difference and still provide an accurate and precise cutting guide mark. The scribe embodying the present invention is very easy to transport and thus can be available to the worker at any time and anywhere it is needed.

Still further, the scribe embodying the present invention is easily adaptable for use with additional geometric instruments, such as a ruler. However, the scribe embodying the present invention can be used by itself without requiring any additional instruments for its proper use.

BRIEF DESCRIPTION OF THE DRAWING FIGURES

FIG. 3A illustrates an initial step of temporarily attaching one conduit to another in the method of using the scribe as embodied in the present invention.

FIG. 3B illustrates a step of marking one conduit using the other conduit as a guide as embodied in the present invention.

FIG. 3C shows one conduit attached to the other.

FIG. 3D is a side elevational view of a conduit after it has been marked and cut in preparation for attaching the conduit with another conduit as embodied in the present invention.

FIG. 4 is a perspective view showing one conduit attached to the other.

DETAILED DESCRIPTION OF THE PREFERRED EMBODIMENT

Other objects, features and advantages of the invention will become apparent from a consideration of the following detailed description and the accompanying drawings.

Figure 1:
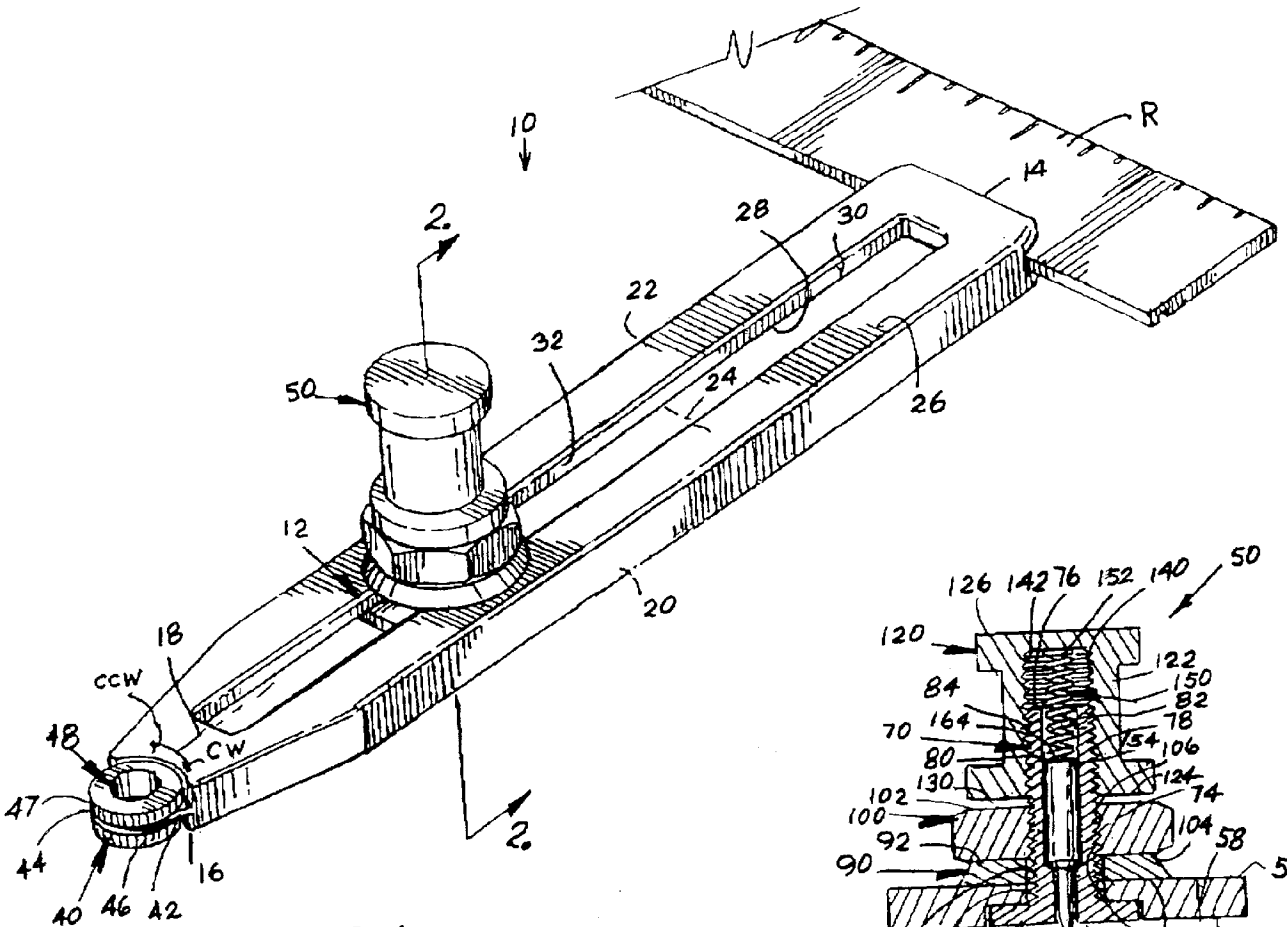
FIG. 1 is a perspective view of a scribe embodying the present invention.
Figure 2:
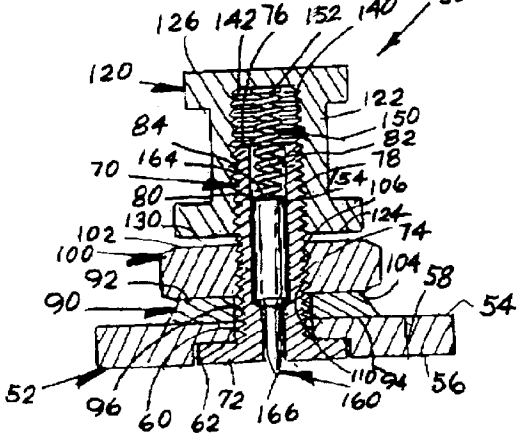
FIG. 2 is a is an elevational view taken along line 2—2 of FIG. 1.

Referring to FIGS. 1 and 2, it can be understood that the present invention is embodied in a conduit marking scribe 10 that can be used to precisely and accurately place a cutting guide mark on a conduit and will thereby eliminate the need for a template. Scribe 10 comprises a body element 12. Body element 12 includes a first end 14, a second end 16, and a longitudinal axis 18 which extends between the first end 14 of the body element 12 and the second end 16 of the body element 12.

The body element 12 further includes a first side 20, a second side 22, and a transverse axis 24 which extends between the first side 20 of the body element 12 and the second side 22 of the body element 12.

The body element 12 further includes a first surface 26, a second surface 28, and a thickness dimension 30 which extends between the first surface 26 of the body element 12 and the second surface 28 of the body element 12.

A slot 32 is defined in the body element 12 and extends from adjacent to the first end 14 of the body element 12 to adjacent to the second end 16 of the body element 12; the slot 32 also extends from the first surface 26 of the body element 12 to the second surface 28 of the body element 12.

A pivot unit 40 is located on the second end 16 of the body element 12. Pivot unit 40 is adapted to contact and move along the outer surface of a first conduit C1 (see FIG. 4) which will be engaged with a second conduit C2 after the second conduit has been cut to accommodate the first conduit.

Pivot unit 40 includes a mounting ear 42 on the second end 16 of the body element 12 and a wheel 44 rotatably mounted on the ear 42 to rotate in a plane containing the transverse axis 24 of the body element 12. Wheel 44 has an outer circumference 46 and rotates on the mounting ear 42 clockwise CW and counterclockwise CCW with respect to the first and second sides 20, 22 of the body element 12. Pivot unit 40 further includes knurling 47 on the outer circumference 46 of the wheel 44, and a center hole 48 which is defined through the wheel 44 and through the mounting ear 42.

A scribe unit 50 is movably mounted on the body element 12, and is shown in FIG. 2. Scribe unit 50 includes a frame 52 having a first surface 54, a second surface 56, and a thickness dimension 58 that extends in the direction of the thickness dimension 30 of the body element 12 when the first surface 54 of the frame 52 is positioned to abut the second surface 28 of the body element 12 (see FIG. 1). Frame 50 has a hole 60 defined therethrough with the hole 60 being oriented to extend in the direction of the thickness dimension 30 of the body element 12 when the first surface 54 of the frame 52 is in contact with the second surface 28 of the body element 12. A counterbore 62 is defined in the second surface 56 of the frame 52 adjacent to the hole 60 defined through the frame 52.

Scribe unit 50 further includes a bored bolt 70 which includes a head end 72 located in the counterbore 62 defined in the second surface 56 of the frame 52 when the bored bolt 70 is in place on the frame 52 as shown in FIG. 2. A bolt body 74 extends from the head 72 of the bored bolt 70 through hole 60 defined through the frame 52 to extend through slot 32 defined in the body element 12 when the scribe unit 50 is in place mounted on the body element 12 as indicated in FIGS. 1 and 2. The bored bolt 70 further includes a second end 76 and an outer surface 78 on the bored bolt body 74. A bore 80 is defined in the bored bolt body 74 and extends from the head 72 of the bored bolt 70 to the second end 76 of the bored bolt 70. Bored bolt 70 has an inner surface 82 located adjacent to the bore 80 defined in the bored bolt body 74. A screw thread 84 is defined in the outer surface 78 of the bored bolt body 74.

An annular washer 90 has a first surface 92 and a second surface 94. Second surface 94 of the annular washer 90 is located to contact the first surface 54 of the frame 52 when the annular washer 90 is in place on the frame 52 as shown in FIG. 2. The annular washer 90 has a hole 96 defined therethrough. Hole 96 extends from the first surface 92 of the washer 90 to the second surface 94 of the washer 90 and is aligned with hole 60 defined through the frame 52 when the washer 90 is in place as shown in FIG. 2.

An annular nut 100 has a first surface 102 and a second surface 104, with the second surface 104 of the annular nut 100 contacting the first surface 92 of the annular washer 90 when the washer 90 and the nut 100 are in place as shown in FIG. 2. Nut 100 has a hole 106 defined therethrough from the first surface 102 of the nut 100 to the second surface 104 of the nut 100. Hole 106 is aligned with hole 96 defined through the washer 90 and is aligned with hole 60 defined through the frame 52 when the nut 100 and the washer 90 are in place on the frame 52 as shown in FIG. 2. Nut 100 has a screw thread 110 defined thereon adjacent to the hole 106 defined through the nut 100. The screw thread 110 on the nut 100 threadably engages the screw thread 84 on the bored bolt 70 when the bored bolt 70 and the nut 100 are in place, on the frame 52.

A bored knob 120 is located on the bored bolt 70 when the knob 120 is in place as shown in FIG. 2. Bored knob 120 includes a body 122, a first end 124 on the body 122 of the knob 120, and a second end 126 on the body 122 of the knob 120. First end 124 of the bored knob 120 is spaced apart from first surface 102 of nut 100 to define a gap 130 between the bored knob 120 and the nut 100 when the knob 120 and the nut 100 are in place on the bored bolt 70 as shown in FIG. 2. Body element 12 is interposed between the nut 100 and the knob 120 when the scribe unit 50 is in place on the body element 12 with the first surface 26 of the body element 12 in contact with the first end 124 of the knob 120 and the second surface 28 of the body element 12 in contact with the first surface 102 of the nut 100 whereby the scribe unit 50 is held in place on the body element 12 through frictional engagement with the body element 12.

A blind-ended bore 140 is defined in the bored knob 120. The blind-ended bore 140 extends from the first end 124 of the knob 120 toward the second end 126 of the knob 120 and is aligned with the hole 106 defined through the nut 100 when the knob 120 and the nut 100 are in place on the bored bolt 70 as shown in FIG. 2.

A screw thread 142 is defined on the bored knob 120 adjacent to the blind-ended bore 140. The screw thread 142 on the knob 120 and the screw thread 84 on the bored bolt 70 are threadably engaged with each other when the knob 120 is in place on the bolt 70 as shown in FIG. 2.

A compression spring 150 is located inside the blind-ended bore 140 and has a first end 152 abutting the knob 120 adjacent to the blind-ended bore 140 and a second end 154 located inside the bore 106 defined through the bored nut 100 when the knob 120 is in place on the bored bolt 70 and the spring 150 is in place in the blind-ended bore 140 as shown in FIG. 2.

A scribe element 160 is movably positioned inside the bore 80 of the bored bolt 70 when the scribe element 160 is in place as shown in FIG. 2. The scribe element 160 includes a proximal end 164 in abutting contact with a second end of the spring 150 when the scribe element 160 is in place in the bore of the bored bolt 70 and a distal end 166 which is located adjacent to the head 72 of the bored bolt 70 when the scribe element 160 is in place. The scribe element 160 moves between a first position in which the distal end 166 of the scribe element 160 is located inside the bore 80 of the bored bolt 70 and a second position shown in FIG. 2 in which the distal end 166 of the scribe element 160 is located outside the bore 80 of the bored bolt 70. The spring 150 biases the scribe element 160 toward the second position. The distal end of the scribe element is adapted to contact outer surface S2 of second conduit C2 while the pivot unit 40 is in contact with first conduit C1.

Referring to FIGS. 3A–4, it can be understood that the present invention is also embodied in a method of scribing a conduit, which comprises marking a conduit which includes providing the scribe unit 50 described above, temporarily attaching one end E, as by a tack weld W, of the second conduit to the outer surface of the first conduit at a location L where the second conduit will be joined to the first conduit as indicated in FIG. 3A; contacting the wheel 44 against the outer surface S1 of the first conduit, the knurling 47 providing a good grip on the conduit; locating the scribe unit 50 against outer surface S2 of the second conduit; contacting the distal end 166 of the scribe unit 50 against outer surface S1 of the first conduit; and marking the second conduit by moving the scribe unit 50 with respect to the first conduit and with respect to the second conduit so the distal end 166 of the scribe unit 50 engages and marks the second conduit while the wheel 44 of the pivot unit 40 remains in contact with the outer surface of the first conduit and moves over the outer surface of the first conduit as indicated in FIG. 3B. As will be understood by those skilled in the art based on the teaching of this disclosure, the distal end 166 of the scribe unit 50 is forced out of the blind-ended bore 140 by the biasing of the spring 150 and is forced out far enough to remain in contact with the curved outer surface of conduit C2 even when that outer surface is located farthest away from the scribe unit 50. The marking process is repeated for as many cuts as will be made in the second conduit. There are two cuts made in the second conduit in FIGS. 3A and 3B, and the final product for conduit C2 is indicated in FIG. 4. Conduit C1 will be joined to conduit C2 by weld W2.

As indicated in FIG. 3C, the first and second conduits are then joined together along the cuts made in the second conduit. The temporary joining of the two conduits can be effected by tack welds, and the final joining of the two conduits can be effected by welding.

The final product is indicated in FIG. 4 with the first and second conduits joined together.

While the conduit marking device described above can be used without any other instruments, if desired, the conduit marking device 10 can also be used in conjunction with another instrument, such as a ruler R shown in FIG. 1.

It is understood that while certain forms of the present invention have been illustrated and described herein, it is not to be limited to the specific forms or arrangements of parts described and shown.

What is claimed and desired to be covered by Letters Patent is:

1. A conduit marking scribe comprising:

a) a body element which includes
- (1) a first end,
- (2) a second end,
- (3) a longitudinal axis extending between the first end of said body element and the second end of said body element,
- (4) a first side,
- (5) a second side,
- (6) a transverse axis extending between the first side of said body element and the second side of said body element,
- (7) a first surface,
- (8) a second surface,
- (9) a thickness dimension extending between the first surface of said body element and the second surface of said body element, and
- (10) a slot defined in said body element and extending from adjacent to the first end of said body element to adjacent to the second end of said body element and extending from the first surface of said body element to the second surface of said body element;

b) a pivot unit on the second end of said body element, said pivot unit being adapted to contact and move along the outer surface of a first conduit which will be engaged with a second conduit after the second conduit has been cut to accommodate the first conduit, said pivot unit including
- (1) a mounting ear on the second end of said body element,
- (2) a wheel rotatably mounted on the ear to rotate in a plane containing the transverse axis of said body element, the wheel having an outer-circumference and rotating on the mounting ear clockwise and counterclockwise with respect to the first and second sides of said body element,
- (3) knurling on the outer circumference of the wheel, and
- (4) a center hole defined through the wheel and through the mounting ear; and c) a scribe unit movably mounted on said body element, said scribe unit including
- (1) a frame having a first surface and a second surface and a thickness dimension that extends in the direction of the thickness dimension of said body element when the first surface of the frame is positioned to abut the second surface of said body element, the frame having a hole defined therethrough with the hole being oriented to extend in the direction of the thickness dimension of said body element when the first surface of the frame is in contact with the second surface of said body element,
- (2) a counterbore defined in the second surface of the frame adjacent to the hole defined through the frame,
- (3) a bored bolt including
  - (A) a head end located in the counterbore defined in the second surface of the frame when the bored bolt is in place on the frame,
  - (B) a bolt body which extends from the head of the bored bolt through the hole defined through the frame to extend through the slot defined in said body element when said scribe unit is in place mounted on said body element, (C) a second end, (D) an outer surface on the bored bolt body, (E) a bore defined in the bored bolt body and which extends from the head of the bored bolt to the second end of the bored bolt, the bored bolt having an inner surface located adjacent to the bore defined in the bored bolt body, and (F) a screw thread defined in the outer surface of the bored bolt body, (4) an annular washer having a first surface and a second surface, the second surface of the annular washer being located to contact the first surface of the frame when the annular washer is in place on the frame, the annular washer having a hole defined therethrough, the hole defined through the annular washer extending from the first surface of the washer to the second surface of the washer and is aligned with the hole defined through the frame when the washer is in place, (5) an annular nut having a first surface and a second surface, the second surface of the annular nut contacting the first surface of the annular washer when the washer and the nut are in place, the nut having a hole defined therethrough from the first surface of the nut to the second surface of the nut, the hole defined through the nut being aligned with the hole defined through the washer and with the hole defined through the frame when the nut and the washer are in place on the frame, the nut having a screw thread defined thereon adjacent to the hole defined through the nut, the screw thread on the nut threadably engaging the screw thread on the bored bolt when the bored bolt and the nut are in place on the frame, (6) a bored knob, the bored knob including (A) a body, (B) a first end on the body of the knob, (C) a second end on the body of the knob, the first end of the bored knob being spaced apart from the first surface of the nut to define a gap between the bored knob and the nut when the knob and the nut are in place on the bored bolt, said body element being interposed between the nut and the knob when said scribe unit is in place on said body element with the first surface of said body element in contact with the first end of the knob and the second surface of said body element in contact with the first surface of the nut whereby said scribe unit is held in place on said body element through frictional engagement with said body element, (D) a blind-ended bore defined in the bored knob, the blind-ended bore extending from the first end of the knob toward the second end of the knob, the blind-ended bore being aligned with the hole defined through the nut when the knob and the nut are in place on the bored bolt, and (E) a screw thread defined on the bored knob adjacent to the blind-ended bore, the screw thread on the knob and the screw thread on the bored bolt being threadably engaged with each other when the knob is in place on the bolt, (7) a compression spring located inside the blind-ended bore and having a first end abutting the knob adjacent to the blind-ended bore and having a second end located inside the bore defined through the bored nut when the knob is in place on the bored bolt and the spring is in place in the blind-ended bore, and (8) a scribe element movably positioned inside the bore of the bored bolt when the scribe element is in place, the scribe element including a proximal end in abutting contact with the second end of the spring when the scribe element is in place in the bore of the bored bolt and a distal end which is located adjacent to the head of the bored bolt when the scribe element is in place, the scribe element moving between a first position in which the distal end of the scribe element is located inside the bore of the bored bolt and a second position in which the distal, end of the scribe element is located outside the bore of the bored bolt, the spring biasing the scribe element toward the second position, the distal end of the scribe element being adapted to contact the outer surface of the second conduit while the pivot unit is in contact with the first conduit.

2. The conduit marking scribe as described in claim 1 further including a ruler adapted to contact the first end of said body element.

3. A method of scribing a conduit comprising a) providing a conduit marking scribe having (1) a body element which includes (A) a first end, (B) a second end, (C) a longitudinal axis extending between the first end of said body element and the second end of said body element, (D) a first side, (E) a second side, (F) a transverse axis extending between the first side of said body element and the second side of said body element, (G) a first surface, (H) a second surface, (I) a thickness dimension extending between the first surface of said body element and the second surface of said body element, and (J) a slot defined in said body element and extending from adjacent to the first end of said body element to adjacent to the second end of said body element and extending from the first surface of said body element to the second surface of said body element;

(2) a pivot unit on the second end of said body element, said pivot unit being adapted to contact and move along the outer surface of a first conduit which will be engaged with a second conduit after the second conduit has been cut to accommodate the first conduit, said pivot unit including (A) a mounting ear on the second end of said body element, (B) a wheel rotatably mounted on the ear to rotate in a plane containing the transverse axis of said body element, the wheel having an outer circumference and rotating on the mounting ear clockwise and counterclockwise with respect to the first and second sides of said body element, (C) knurling on the outer circumference of the wheel, and (D) a center hole defined through the wheel and through the mounting ear; and (3) a scribe unit movably mounted on said body element, said scribe unit including (A) a frame having a first surface and a second surface and a thickness dimension that extends in the direction of the thickness dimension of said body element when the first surface of the frame is positioned to abut the second surface of said body element, the frame having a hole defined therethrough with the hole being oriented to extend in the direction of the thickness dimension of said body element when the first surface of the frame is in contact with the second surface of said body element, (B) a counterbore defined in the second surface of the frame adjacent to the hole defined through the frame, (C) a bored bolt including (I) a head end located in the counterbore define din the second surface of the frame when the bored bolt is in place on the frame, (ii) a bolt body which extends from the head of the bored bolt through the hole defined through the frame to extend through the slot defined in said body element when said scribe unit is in place mounted on said body element, (iii) a second end, (iv) an outer surface on the bored bolt body, (v) a bore defined in the bored bolt body and which extends from the head of the bored bolt to the second end of the bored bolt, the bored bolt having an inner surface located adjacent to the bore defined in the bored bolt body, and (vi) a screw thread defined in the outer surface of the bored bolt body, (D) an annular washer having a first surface and a second surface, the second surface of the annular washer being located to contact the first surface of the frame when the annular washer is in place on the frame, the annular washer having a hole defined therethrough, the hole defined through the annular washer extending from the first surface of the washer to the second surface of the washer and is aligned with the hole defined through the frame when the washer is in place, (E) an annular nut having a first surface and a second surface, the second surface of the annular nut contacting the first surface of the annular washer when the washer and the nut are in place, the nut having a hole defined therethrough from the first surface of the nut to the second surface of the nut, the hole defined through the nut being aligned with the hole defined through the washer and with the hole defined through the frame when the nut and the washer are in place on the frame, the nut having a screw thread defined thereon adjacent to the hole defined through the nut, the screw thread on the nut threadably engaging the screw thread on the bored bolt when the bored bolt and the nut are in place on the frame, (F) a bored knob, the bored knob including (I) a body, (ii) a first end on the body of the knob, (iii) a second end on the body of the knob, the first end of the bored knob being spaced apart from the first surface of the nut to define a gap between the bored knob and the nut when the knob and the nut are in place on the bored bolt, said body element being interposed between the nut and the knob when said scribe unit is in place on said body element with the first surface of said body element in contact with the first end of the knob and the second surface of said body element in contact with the first surface of the nut whereby said scribe unit is held in place on said body element through frictional engagement with said body element, (iv) a blind-ended bore defined in the bored knob, the blind-ended bore extending from the first end of the knob toward the second end of the knob, the blind-ended bore being aligned with the hole defined through the nut when the knob and the nut are in place on the bored bolt, and (v) a screw thread defined on the bored knob adjacent to the blind-ended bore, the screw thread on the knob and the screw thread on the bored bolt being threadably engaged with each other when the knob is in place on the bolt, (G) a compression spring located inside the blind-ended bore and having a first end abutting the knob adjacent to the blind-ended bore and having a second end located inside the bore defined through the bored nut when the knob is in placed on the bored bolt and the spring is in place in the blind-ended bore, and (H) a scribe element movably positioned inside the bore of the bored bolt when the scribe element is in place, the scribe element including a proximal end in abutting contact with the second end of the spring when the scribe element is in place in the bore of the bored bolt and a distal end which is located adjacent to the head of the bored bolt when the scribe element is in place, the scribe element moving between a first position in which the distal end of the scribe element is located inside the bore of the bored bolt and a second position in which the distal end of the scribe element is located outside the bore of the bored bolt, the spring biasing the scribe element toward the second position, the distal end of the scribe element being adapted to contact the outer surface of the second conduit while the pivot unit is in contact with the first conduit;

b) temporarily attaching one end of the second conduit to the outer surface of the first conduit at a location where the second conduit will be joined to the first conduit;

c) contacting the wheel against the outer surface of the first conduit;

d) locating the scribe unit against the outer surface of the second conduit;

e) contacting the distal end of the scribe unit against the outer surface of the first conduit; and f) marking the second conduit by moving the scribe unit with respect to the first conduit and with respect to the second conduit so the distal end of the scribe unit engages and marks the second conduit while the wheel of the pivot unit remains in contact with the outer surface of the first conduit and moves over the outer surface of the first conduit.

4. The method as described in claim 3 further including steps of joining the first conduit to the second conduit by cutting the second conduit along the mark made on the second conduit; and joining the second conduit to the first conduit adjacent to the cut made in the second conduit.

* * * * *